United States Patent [19]

Tran

[11] Patent Number: 5,035,578

[45] Date of Patent: Jul. 30, 1991

[54] BLADING FOR REACTION TURBINE BLADE ROW

[75] Inventor: Mank H. Tran, Orlando, Fla.

[73] Assignee: Westinghouse Electric Corp., Pittsburgh, Pa.

[21] Appl. No.: 422,333

[22] Filed: Oct. 16, 1989

[51] Int. Cl.[5] ..... F01D 5/14; F01D 5/22

[52] U.S. Cl. ..... 416/223 A; 416/189; 416/DIG. 2

[58] Field of Search ..... 416/189, 190, 191, 192, 416/223 R, 223 A, 242, 243, DIG. 2, DIG. 5

[56] References Cited

U.S. PATENT DOCUMENTS

| | | | |
|---|---|---|---|
| 1,010,750 | 12/1911 | Green | 416/192 |
| 1,152,812 | 9/1915 | Hanzlik | 416/189 |
| 1,601,614 | 9/1926 | Fleming | 416/242 |
| 1,635,966 | 7/1927 | Stanton | 416/189 R |
| 1,720,754 | 7/1929 | Baumann | 416/189 X |
| 1,820,467 | 8/1931 | Liska | 416/189 B |
| 2,350,310 | 5/1944 | Dahlstrand | 416/192 |
| 2,366,142 | 12/1944 | Allen | 416/189 |
| 3,584,971 | 6/1971 | Ortolano | 416/191 X |
| 3,588,279 | 6/1971 | McGinnis | 416/191 |
| 4,066,384 | 1/1978 | DiFerdinando | 416/189 |
| 4,211,516 | 7/1980 | Speil | 416/191 |
| 4,411,598 | 10/1983 | Okada | 416/DIG. 2 X |
| 4,773,825 | 9/1988 | Rodde et al. | 416/223 R |

FOREIGN PATENT DOCUMENTS

| | | | |
|---|---|---|---|
| 142908 | 11/1980 | Japan | 416/189 |

*Primary Examiner*—Edward K. Look
*Assistant Examiner*—James A. Larson

[57] ABSTRACT

A blade for a steam turbine has a concave, pressure-side surface which has a constant radius of curvature, while the convex, suction-side surface has a continuously increasing radius curvature. The constantly increasing radius of curvature allows fluid to accelerate and thus ensure a small boundary layer of thickness. The center of gravity of the blade tenon is located above the center of gravity of the airfoil which will reduce the steam bending stress applied at the base of the airfoil as well as at the root of the rotor blade.

9 Claims, 2 Drawing Sheets

BLADING FOR REACTION TURBINE BLADE ROW

BACKGROUND OF THE INVENTION

1. Field of the Invention

The present invention relate generally to steam turbine rotor blades and, more particularly, to a new turbine blade design having a more aerodynamically efficient profile.

2. Description of the Related Art

Turbine efficiency can be improved by reducing blading losses. Turbine efficiency encompasses several parameters such as steam conditions, cycle arrangement and blading internal efficiency. Of these parameters, internal efficiency is probably the most critical one, since performance and blade efficiency are synonymous.

Two of the major parameters considered in the design of new control stage and reaction stage blading are (1) controlled radial flow distribution to minimize losses and (2) improved aerodynamic performance of stationary and rotating blades.

Control stage blades must operate over a wide range of conditions, such as pressure ratios of 1.2 to 3.5. This is due primarily to the fact that this stage of blading operates from partial arc to full arc of admission and as such the steam velocity leaving the nozzle will be subsonic at full arc of admission to transonic at the primary arc of admission. In the primary arc, the nozzle exit Mach numbers can reach levels of 1.3.

In general, the aspect ratio (height/width) of the control stage blading is small and the flow turning angle across the rotating blade is high, consistent with impulse-type blading. Depending upon the arc of admission, the flow turning angle across the rotating blade can be as high as 140°.

Low aspect ratio and high turning angle lead to high secondary flow loss which often can be of the same magnitude as the profile loss, and in many cases may be predominant. The essential goal in improving control stage blading performance, is to minimize the effect of secondary flow, as well as to reduce profile loss.

In one of the areas of turbine blade design, in which the blades of a given row have a twisting profile and thus a constantly changing geometry progressively along the length thereof, it becomes critical to tune the blade so that its resonant frequencies at various vibrational modes fall safely between the harmonics of running speed associated with the turbine so as not to induce destructive vibration.

Other blades have a constant profile, i.e., no twisting along the length thereof. These blades do not require tuning since they tend to be thicker and thus stronger. In particular, when using these blades for rotor blades, they must be strong enough for operation through resonance. However, even with this type of blade, it is desireable to keep the width as small as possible since a small width gives the best performance. If the width is reduced too much, the blade will not be able to withstand load or stress which may cause the blade to fail.

In designing any blade used in a steam turbine, a number of parameters must be scrupulously considered. When designing blades for a new steam turbine, a profile developer is given a certain flow field with which to work. The flow field is determined by the inlet and outlet angles (for steam passing between adjacent rotor blades of a row), gaging, and the velocity ratio, among other things. "Gaging" is the ratio of throat to pitch; "throat" is the straight line distance between the trailing edge of one rotor blade and the suction-side surface of an adjacent blade, and "pitch" is the distance between the trailing edges of adjacent rotor blades. These parameters are well known to persons of ordinary skill in the art and play an important role in the design of every new rotor or stationary blade.

Other general blade design considerations include the following: blades having tenons have to have the location of the blade tenon as close as possible to the center of gravity of the blade; the trailing edge of the blade has to be very close to the edge of the platform; and the center of gravity of the airfoil must be as close to the center gravity of the platform as possible to minimize eccentric stress forces on the root of the blade.

A continuing need exists for blade designs which have increased aerodynamic efficiency, leading to increased thermal efficiency of the turbine, without concomitant losses in structural strength.

SUMMARY OF THE INVENTION

An object of the present invention is to provide a new turbine blade design which is more aerodynamically efficient than designs used in the past.

Another object of the present invention is to provide a new blade design which is capable of being retrofitted into an existing turbine.

Another object of the present invention is to provide a new turbine blade design which results in increased blading reliability and increased thermal performance by increasing the thermal output in high pressure, intermediate pressure, and the front end of low pressure turbines.

These and other object of the present invention are met by providing a blade for a steam turbine which includes a leading edge, a trailing edge, a concave, pressure-side surface extending between the leading and trailing edges and having a radius of curvature, and a convex, suction-side surface extending between the leading and trailing edges and having a radius of curvature, wherein the radius of curvature along the convex, suction-side surface continuously increases from the leading edge to the trailing edge. Preferably, the radius of curvature along the concave pressure-side surface remains substantially constant.

These and other features and advantages of the blading for reaction turbine blade row will become more apparent with reference to the following detailed description and drawings.

DETAILED DESCRIPTION OF THE PREFERRED EMBODIMENTS

Steam turbine rotor blades are generally well known to include an airfoil portion, a platform portion, and a root portion. The root portion is used to mount the blade on the rotor (for "rotary" blades) or on the cylinder (for "stationary" blades). Blade root design and considerations are not the subject of the present invention, and thus, details of the root and platform portions of the blade have been omitted.

Figure 1:
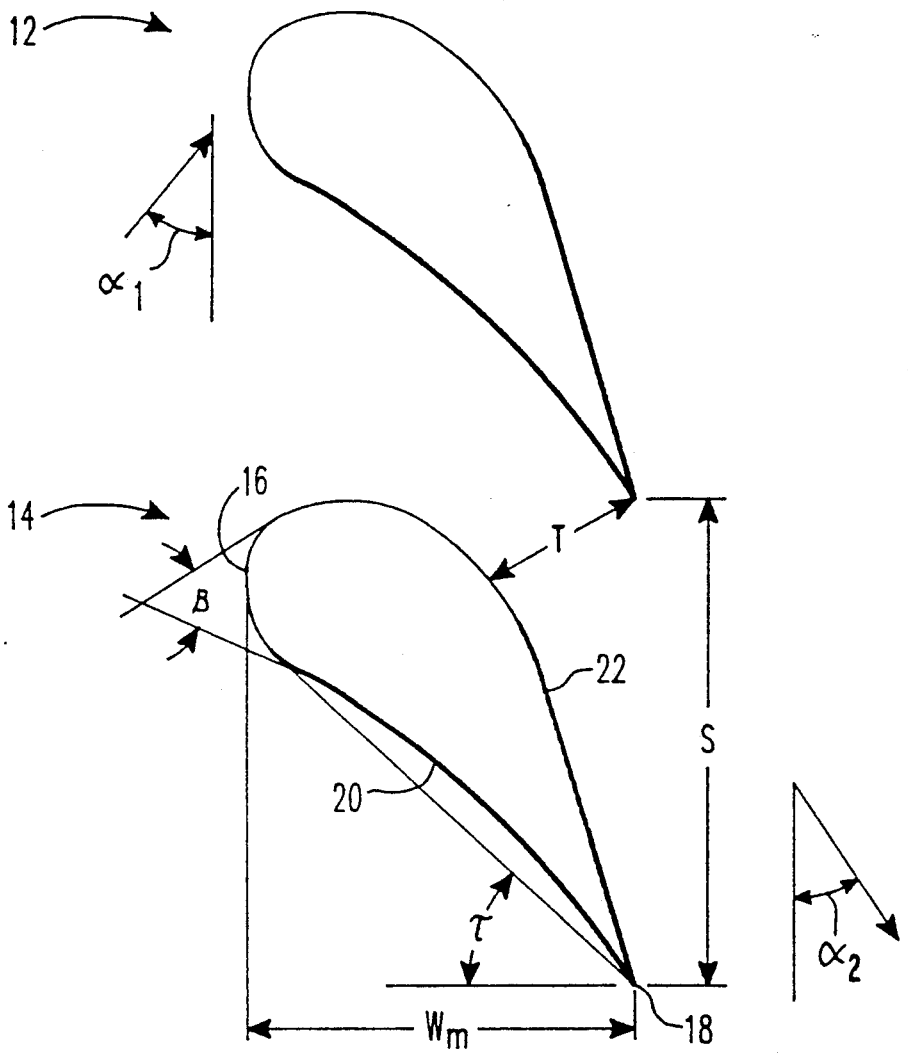
FIG. 1 is a cross-sectional view of the airfoil portion of two adjacent steam turbine rotor blades of a given row.

Since the present invention relates to a particular type of blade in which the profile is constant from the platform to the tip of the blade, cross-sectional views of adjacent blades illustrated in FIG. 1 are sufficient for showing the entire airfoil portion of the blade. Other types of blades which have a twisting profile would have different cross-sectional shapes depending on the position of the cross-sectional view. However, the present invention focuses on the shape of an airfoil portion of a blade, the blade being of the type which has a constant profile.

Referring to FIG. 1, the two adjacent rotor blades are generally referred to by the numerals 12 and 14. Since the blades are identical, the details of blade 14 will be described below.

Blade 14 is for a steam turbine and includes a leading edge 16, a trailing edge 18, a concave, pressure-side surface 20 and a convex, suction-side surface 22.

According to the present invention, the radius of curvature along the convex, suction-side surface 22 continuously increases from the leading edge 16 to the trailing edge 18, beginning at the stagnation point (where velocity=0). Also, the radius of curvature along the concave, pressure-side surface 20 is constant.

The arrangement of constantly increasing curvature and constant curvature applies specifically to an arrangement where the gaging of the blades is in the range of 27–33%, and for blades used in high pressure, intermediate pressure, and the first several stages of the low pressure turbine. Gaging is defined as the ratio of throat to pitch. The "throat" is indicated in FIG. 1 by the letter T, which is the distance between the trailing edge of rotor blades 12 and the suction-side surface of blade 14. The "pitch" is indicated by the letter "S", which represents the straight line distance between the trailing edges of the two adjacent blades 12 and 14.

The width of the blade is indicated by the distance $W_m$, while the blade inlet flow angle and exit flow angle are indicated by the symbols $\alpha_1$ and $\alpha_2$, respectively.

Figure 2:
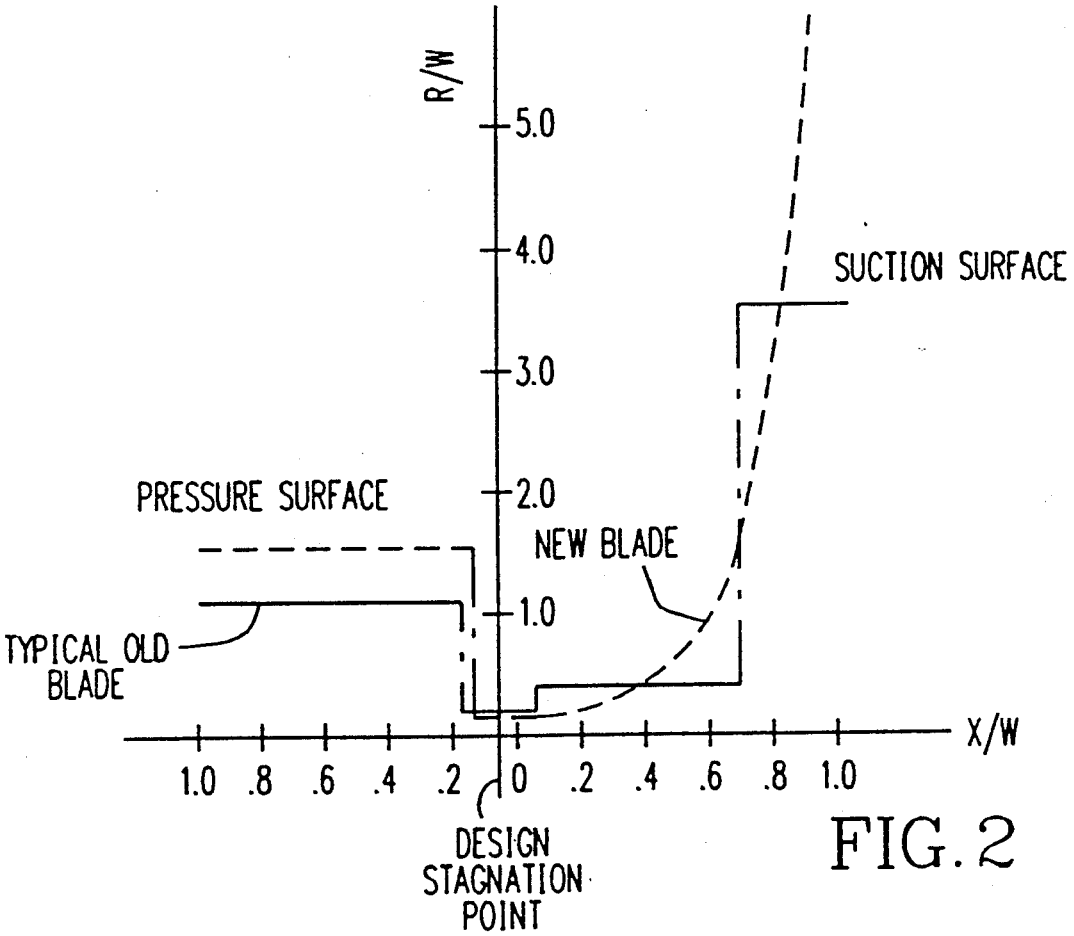
FIG. 2 is a graph comparing characteristics of the radius of curvature of the concave and convex surfaces illustrated in FIG. 1.

The blade described with reference to FIG. 1 was designed to minimize aerodynamic losses associated with its surface contours. The aerodynamic losses can be minimized if the flow is allowed to accelerate along the blade surfaces, thus ensuring a small boundary layer thickness. To accomplish this, the radius of the curvature along the convex surface is increased continuously, while along the concave surface, the radius of curvature is kept constant to facilitate manufacturing. This is illustrated in the graph of FIG. 2, where the ordinate is the ratio of blade to width, and the abscissa X/W is the percent of blade width.

Since the blade must be operated with a wide range of inlet flow angles, a large leading edge included flow angle ($\beta$) is selected.

Different blade gaging can be obtained by varying the blade orientation ($\gamma$). For this blades section, the blade orientation angle of about 46°±3° was selected for optimum performance.

In another aspect of the present invention, the new blade profile can be used in a retrofit, in which the blades of an existing rotor are replaced with newly designed blades. In this situation, an existing tenon design can be utilized with the new blade design. The new blade section according to the present invention was designed so that an existing tenon can fit on the airfoil without increasing the bending stress on the blade.

Figure 3:
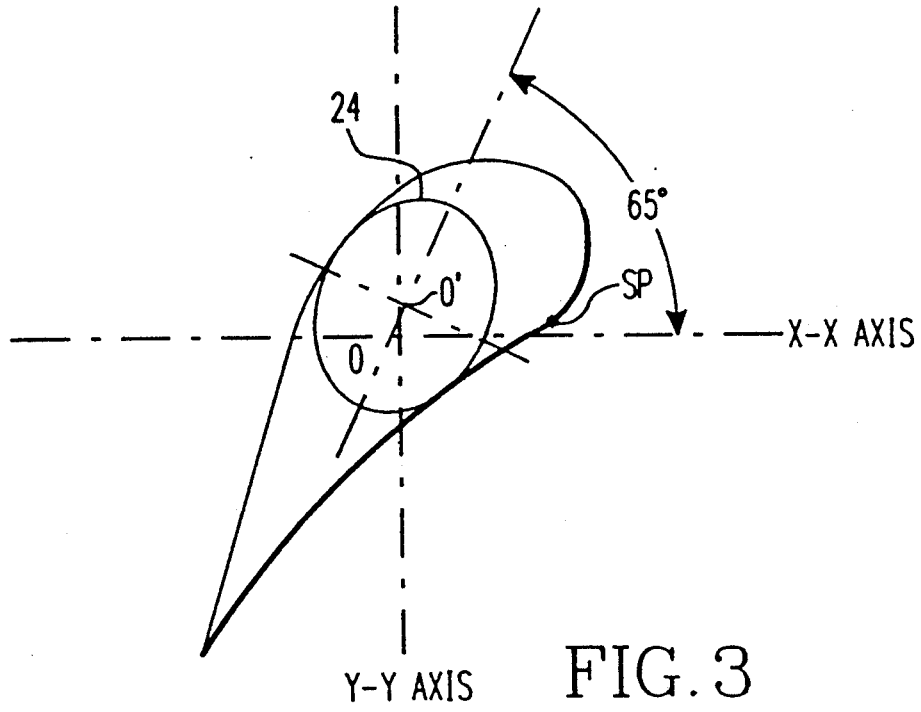
FIG. 3 is a top view showing an airfoil portion of the blade according to the present invention with a tenon on top, and illustrating the location of the blade tenon center of gravity relative to the center of gravity of the blade section.

Referring to FIG. 3, the tenon was stacked on top of the airfoil so that the center of gravity (0') of the tenon is located near the y-y axis and above the center of gravity (o) of the airfoil, which is indicated by the intersection of x—x and y—y. With this arrangement, the tenon, during running conditions, will produce a moment which counteracts the moment applied to the blade by the steam force in the tangential direction (y—y). This will reduce the steam bending stress and increase blading reliability.

The new blade profile can also be applied to blades having an integral shroud, with slight modification to account for bending stresses.

The dimensions illustrated in FIG. 3 are stated for the model blade width, which was referred in FIG. 1 as $W_m$. The new blade section design can be used for different blade widths simply by scaling the coordinates of the model blade by the ratio of $W/W_m$, where W is the preferred blade width and $W_m$ is the model blade width.

The tenon 24 has a center of gravity 0' located along the y—y axis and above the center of gravity o of the airfoil. More specifically, the axis A of the minimum principal moment of inertia of the tenon 24 is at a 65° angle relative to the x—x axis of the blade. With the dimensions illustrated in FIG. 3, the center of gravity of the tenon 24 is spaced 0.737mm from the y—y axis and 4.0386mm above the x—x axis of the blade.

Numerous modifications and adaptions of the present invention will be apparent to those so skilled in the art and thus, it is intended by the following claims to cover such modifications and adaptions which fall within the true spirit and scope of the invention.

We claim:

1. A blade for a steam turbine comprising:

a leading edge;

a trailing edge;

a concave, pressure-side surface extending between the leading and trailing edges, and having a radius of curvature; and a convex, suction-side surface extending between the leading and trailing edges, and having a radius of curvature, said leading edge, trailing edges, convex and concave surfaces forming an airfoil, wherein the radius of curvature along the convex, suction-side surface continuously increases from the leading edge to the trailing edge; and wherein blade orientation is about 46°±3°.

2. A blade for a steam turbine comprising:

a leading edge;

a trailing edge;

a concave, pressure-side surface extending between the leading and trailing edges, and having a radius of curvature; and a convex, suction-side surface extending between the leading and trailing edges, and having a radius of curvature, said leading edge, trailing edge, convex and concave surfaces forming an airfoil, wherein the radius of curvature along the convex, suction-side surface continuously increases from the leading edge to the trailing edge, and wherein the radius of curvature along the concave, pressure-side surface is substantially constant, and wherein blade orientation is about 46°±3°.

3. A blade for a steam turbine comprising:

a leading edge;

a trailing edge;

a concave, pressure-side surface extending between the leading and trailing edges, and having a radius of curvature;

a convex, suction-side surface extending between the leading and trailing edges, and having a radius of curvature, said leading edge, trailing edge, convex and concave surfaces forming an airfoil, wherein the radius of curvature along the convex, suction-side surface continuously increases from the leading edge to the trailing edge; and a tenon formed on top of the airfoil, a cross-section of the tenon having a center of gravity offset from a center of gravity of the blade airfoil, wherein the center of gravity of the airfoil is at an intersection of x—x and y—y axes, and the center of gravity of a cross-section of the tenon is located near the y—y axis and above the center of gravity of the airfoil, wherein the x—x axis is in the direction of the steam flow.

4. A blade for a steam turbine as recited in claim 3, wherein the radius of curvature along the concave, pressure-side surface is substantially constant.

5. A blade for a steam turbine as recited in claim 3, wherein blade orientation is about 46°±3°.

6. A blade for a steam turbine as recited in claim 3, wherein the axis of the minimum principal moment of inertia of the tenon is at about a 65° angle relative to the x—x axis.

7. A blade for a steam turbine comprising:

a leading edge;

a trailing edge;

a concave, pressure-side surface extending between the leading and trailing edges, and having a radius of curvature;

a convex, suction-side surface extending between the leading and trailing edges, and having a radius of curvature, said leading edge, trailing edge, convex and concave surfaces forming an airfoil;

wherein the radius of curvature along the convex, suction-side surface continuously increases from the leading edge to the trailing edge, and wherein the radius of curvature along the concave, pressure-side surface is substantially constant;

a tenon formed on top of the airfoil, a cross-section of the tenon having a center of gravity offset from a center of gravity of the airfoil, wherein the center of gravity of the airfoil is at an intersection of x—x and y—y axes, and he center of gravity of a cross-section of the tenon is located near the y—y axis and above the center of gravity of the airfoil, wherein the x—x axis is in the direction of steam flow.

8. A blade for a steam turbine as recited in claim 7, wherein blade orientation is about 46°±3°.

9. A blade for a steam turbine as recited in claim 7, wherein the minimum principal moment of inertia of the tenon is at about a 65° angle relative to the x—x axis.

* * * * *